United States Patent [19]

Jordan

[11] 4,416,300

[45] Nov. 22, 1983

[54] HEAT SHIELDED THERMOPLASTIC WASH ARM FOR DISHWASHER

[75] Inventor: Lawrence J. Jordan, Newton, Iowa

[73] Assignee: The Maytag Company, Newton, Iowa

[21] Appl. No.: 305,620

[22] Filed: Sep. 25, 1981

[51] Int. Cl.[3] ..... B08B 3/02

[52] U.S. Cl. ..... 134/108; 219/335

[58] Field of Search ..... 134/105, 106, 107, 108; 219/335; 68/15, 16

[56] References Cited

U.S. PATENT DOCUMENTS 3,555,242 1/1971 Jenkins et al. ..... 219/335

4,096,872 6/1978 Herbst et al. ..... 134/105

*Primary Examiner*—Robert L. Bleutge

*Attorney, Agent, or Firm*—Richard L. Ward

[57] ABSTRACT

An article washing apparatus is provided which has a washing chamber and a heating element spaced upwardly from the bottom wall thereof. Apparatus is also provided for distributing washing liquid within the washing chamber including a pump associated with the bottom wall of the washing chamber and a rotatable horizontally elongated thermoplastic wash arm in communication with the pump to effect washing of the articles by spraying liquid thereon. The thermoplastic wash arm is protected from heat radiated by the heating element by at least one generally U-shaped heat reflecting member supported on the rotatable thermoplastic wash arm. The heat reflecting member is positioned between the thermoplastic wash arm and the heating element with a wall portion of the heat reflecting member spaced from the thermoplastic wash arm and providing an air gap therebetween. The wall portion of the heat reflecting member effectively dissipates and reflects radiant heat from the heating element.

10 Claims, 4 Drawing Figures

HEAT SHIELDED THERMOPLASTIC WASH ARM FOR DISHWASHER

BACKGROUND OF THE INVENTION

This invention relates generally to the field of dishwashers and more particularly to an improved thermoplastic wash arm therefore which includes heat shielding apparatus for protecting the thermoplastic wash arm from deformation due to heat during the dish drying portion of a cycle of operations.

Automatic dishwashers of the type which pump washing liquid through rotatable wash arms for distribution within a washing chamber to wash articles placed therein have traditionally utilized wash arms manufactured from stainless steel material. A potential reduction in manufacturing costs can be realized if these wash arms are manufactured from a thermoplastic material. One of the wash arms is usually positioned slightly above the bottom wall of the washing chamber for spraying liquid upwardly onto articles held in a basket. Since dishwashers generally utilize a sheathed electrical heater for heating washing liquid and for heating the washing chamber to dry the washed articles there exists the potential problem that a lower plastic wash arm could be deformed by the radiant heat emitted by the electrical heater.

As a result of this potential problem and a reluctance to design away from a sheathed heater within the washing chamber there has been little movement toward the use of a thermoplastic lower wash arm in a dishwasher. One manufacturer, however utilizes both a thermoplastic washing chamber and a thermoplastic lower wash arm while retaining the sheathed electrical heater mounted to the bottom wall of the washing chamber. In this construction, the electrical heater is designed as a dual wattage element which utilizes a relatively high wattage when the heater is covered with liquid and a relatively low wattage when the heater is exposed to air for drying washed articles. The temperatures adjacent the plastic wash arm are maintained at a low level because of the low wattage of the heater for preventing heat damage to the wash arm. In addition, the heater is an elongated member of relatively low watt density.

While not utilized in a dishwasher having a plastic wash arm, U.S. Pat. No. 3,555,242 shows a generally tubular metal shield surrounding the heater. The tubular shield acts as a secondary heating surface of greater area and lower temperature than the surface of the heater.

In U.S. Pat. No. 4,096,872 a dishwasher having a thermoplastic washing chamber or tub is disclosed. The bottom wall of the washing chamber adjacent the heating element includes a plurality of fluid retaining receptacles. These receptacles retain washing liquid which is evaporated during the drying portion of the cycle to maintain the bottom wall at a safe operating temperature.

While it is noted that a dishwasher having a lower thermoplastic wash arm has been shown and that a metal shield has been shown surrounding a dishwasher heating element, there has been no known showing of a dishwasher which utilizes a thermoplastic lower wash arm having a heat dissipating shield attached thereto. The heat shielded lower thermoplastic wash arm is thus usable with a high wattage heater without the need for a thermostat to limit temperature or a rectifier to limit the wattage of the heater when in the drying portion of a cycle of operations.

SUMMARY OF THE INVENTION

It is therefore an object of the instant invention to provide an improved lower wash arm for a dishwasher.

It is a further object of the instant invention to provide a thermoplastic lower wash arm for a dishwasher having means for shielding the wash arm from radiant heat.

It is another object of the instant invention to provide a thermoplastic lower wash arm for a dishwasher while utilizing a high wattage heater.

Briefly, the instant invention achieves these objects in an article washing apparatus having a washing chamber and a liquid pumping system associated with the bottom wall of the washing chamber. A rotatable horizontally elongated thermoplastic spray arm is associated with the liquid pumping system and is operable for washing the articles by spraying liquid on them. A heater is spaced upwardly from the bottom wall generally subjacent the elongated thermoplastic spray arm and is energizable for heating the washing chamber. A pair of heat dissipating reflective members are attached one at each end of the thermoplastic wash arm and are disposed between the heater and the thermoplastic wash arm with a reflective surface spaced from the thermoplastic wash arm to effectively shield the thermoplastic wash arm from heat radiated by the heating element.

Operation and construction of the heat shield as well as further objects and advantages thereof will become evident as the description proceeds and from an examination of the accompanying two pages of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
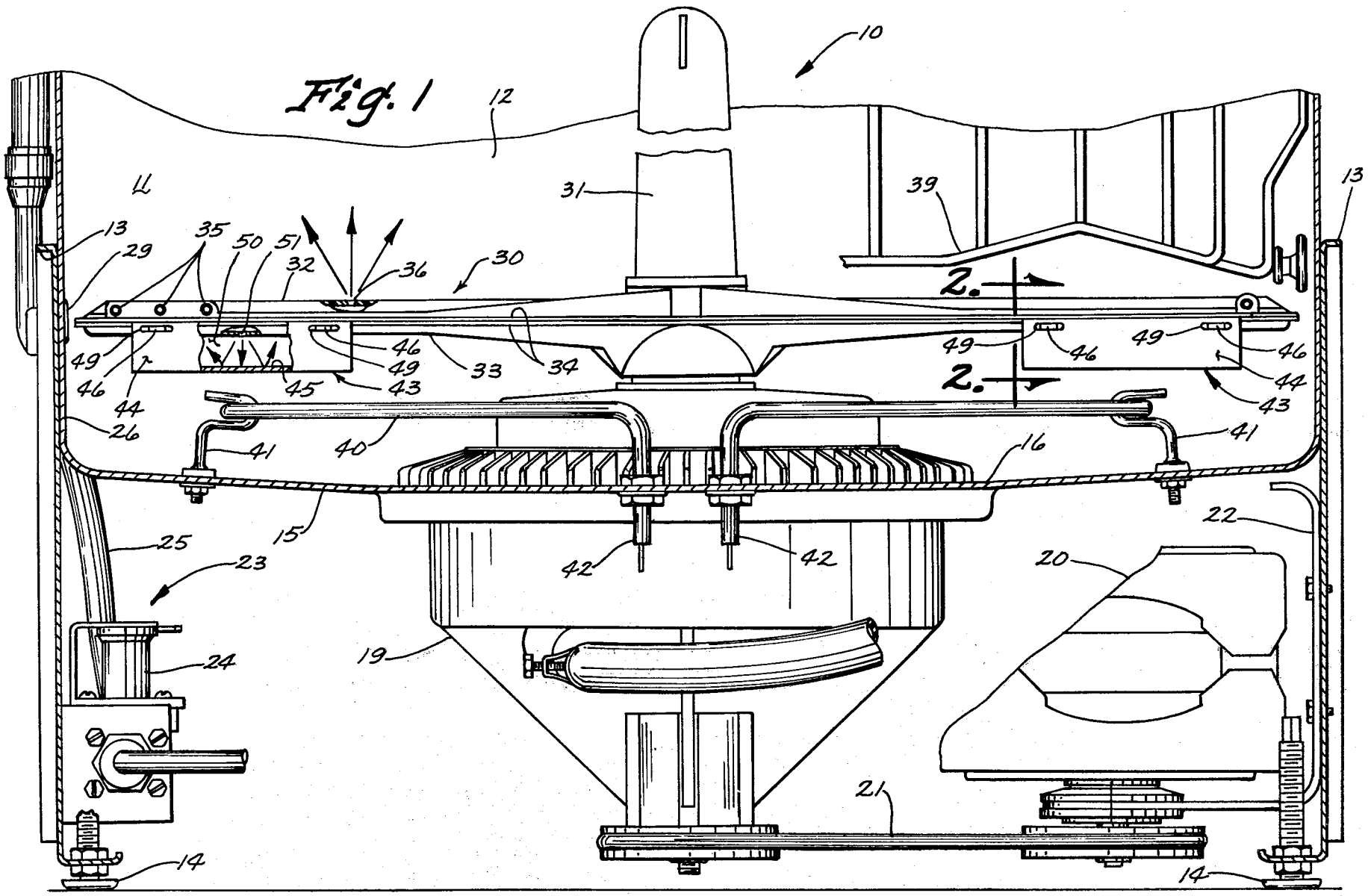
FIG. 1 is a cross sectional view of the lower portion of a dishwashing apparatus showing heat shields attached to the lower thermoplastic wash arm.

Referring now to the drawings there is shown in FIG. 1 a dishwashing apparatus 10. The dishwashing apparatus 10 includes a tub 11 forming a washing chamber 12 to which are attached side supports 13 extending downwardly toward floor engaging members 14. The dishwashing apparatus 10 is supported on a plurality of these floor engaging members 14 on the floor of an appropriate enclosure.

The washing chamber 12 has a bottom wall 15 which includes a generally central recess and opening 16 in which is positioned a combination sump and pump assembly 19 including a recirculating pump operable for effecting a recirculation of washing liquid in the washing chamber 12 and a drain pump for removing washing liquid from the washing chamber 12. The combination sump and pump assembly 19 is drivingly connected to a laterally disposed drive motor 20 through a stretch belt 21 as generally shown in FIG. 1. The drive motor 20 is resiliently mounted to a side support 13 through a mounting bracket 22 as also shown in FIG. 1.

Further shown in FIG. 1 is a portion of the liquid inlet system 23 including an electrically operated fill valve 24 mounted on the side support 13. The conduit 25 from the fill valve 24 extends toward the rear of the dishwashing apparatus 10 and upwardly along the side wall 26 of the tub 11 and connects with the side wall 26 of the tub 11 at inlet 29 for directing washing liquid into the washing chamber 12.

Referring again to FIG. 1, there is shown as an operational part of the combination sump and pump assembly 19, an elongated lower wash arm 30 extending generally horizontally from either side of the vertical center line of the sump and pump assembly 19. A center spray nozzle 31 for directing liquid into the upper portion of the washing chamber 12 is threaded to the sump and pump assembly 19 at the vertical center line and serves to retain the lower wash arm 30 thereon.

In this embodiment of the invention, the lower wash arm 30 is formed in two halves 32 and 33 from a thermoplastic material such as polypropylene. The two halves 32 and 33 are subsequently joined by a process such as hot plate welding along the flanges 34 to form a substantially water tight joint. The wash arm 30 is rotated about the vertical center line of the sump and pump assembly 19 by pumping liquid through the drive holes 35 molded into each end of the upper half 32 of the wash arm 30. A plurality of article spraying holes 36 are also molded into the upper half 32 of the wash arm 30 and are positioned for directing liquid onto articles placed in the basket 39.

Spaced upwardly from the bottom wall 15 of the washing chamber 12 and subjacent the lower half 33 of the wash arm 30 is a sheathed electrical heater 40 energizable for both heating liquid and for heating the inside of the washing chamber 12 to effect the drying of washed dishes. In this embodiment, the heater 40 is formed in a generally circular configuration and concentrically surrounds the centrally located sump and pump assembly 19. The heater 40 is supported on a pair of wire stand-offs 41 extending upwardly from the bottom wall 15 of the washing chamber 12. The ends 42 of the heater 40 extend downwardly through the bottom wall 15 where they are electrically connected to the wiring harness of the dishwashing apparatus 10.

In a normal cycle of operations, if the heater 40 is energized to dry dishes after washing, the proximity of the heater 40 to the lower wash arm 30 could possibly cause overheating of the thermoplastic material. Overheating of the wash arm 30 could result in short term softening of the material or long term heat aging. To negate the short and long term effects of the heater 40 being in such close proximity to the lower plastic wash arm 30, a pair of heat radiating and reflecting heat shields 43 are attached one at each end of the lower wash arm 30 at the radius of the heater 40 as best shown in FIG. 1.

Figure 2:
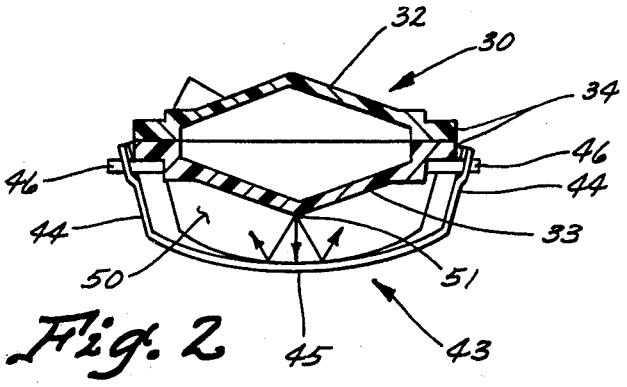
FIG. 2 is a cross sectional view taken through the lower thermoplastic wash arm generally along lines 2—2 of FIG. 1.

The generally U-shaped heat shield 43, as shown in FIGS. 1 and 2, is formed from a light gage stainless steel material for longevity in the corrosive environment of the dishwashing apparatus 10 and for maintaining the desired reflective qualities. As best shown in FIG. 2, the sides 44 of the heat shield 43 generally converge toward a point located beyond the ends of the wash arm 30 and are generally parallel with the sides of the wash arm 30. The bottom surface or wall portion 45 of the heat shield 43 is arcuately formed to a concave shape as best shown in FIG. 2 and is spaced below the lower half 33 of the wash arm 30. The arcuate shape of the bottom surface 45 is desirable to maintain a substantially even spacing of the bottom surface 45 from the lower half 33 of the lower wash arm 30 and to enhance the reflectivity of the heat shield 43. Each end of the wash arm 30 further includes four molded tabs 46, two per side. These molded tabs are engageable with four matching slots 49 in the sides 44 of each heat shield 43 for attaching the heat shields 43 to the ends of the wash arm 30. As further shown in FIG. 2, the arcuately formed bottom surface 45 of each U-shaped heat shield 43 is substantially evenly spaced from the lower half 33 of the wash arm 30 to provide a heat dissipating air gap 50 therebetween.

The lower half 33 of the wash arm 30 also includes a downwardly directed spray hole 51 at each end thereof. This spray hole 51 directs a stream of washing liquid generally at the center of the heat shield 43 which is operable for removing food particles and other debris which might otherwise collect on the arcuate bottom surface 45 of the heat shield 43.

Figure 3:
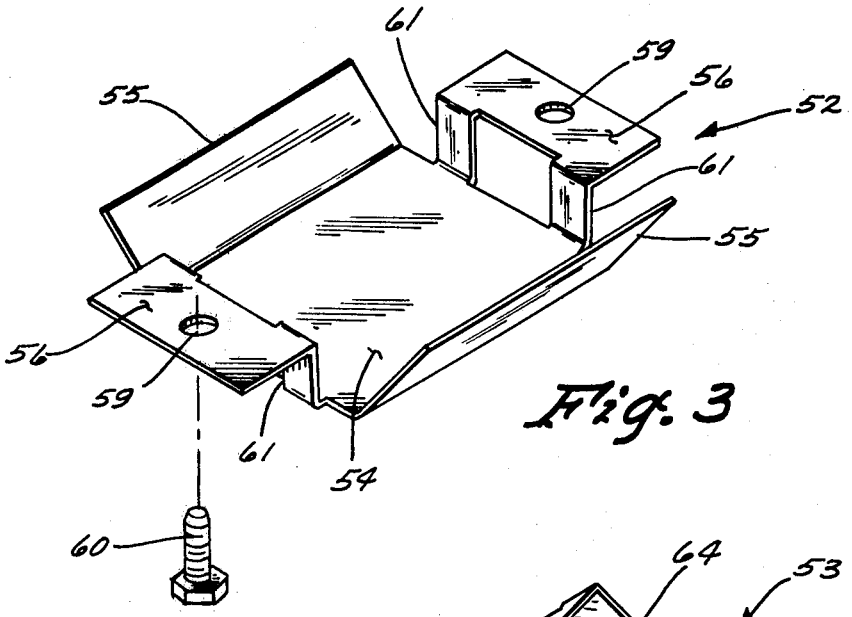
FIG. 3 is a perspective view showing an alternate embodiment of the heat shield.
Figure 4:
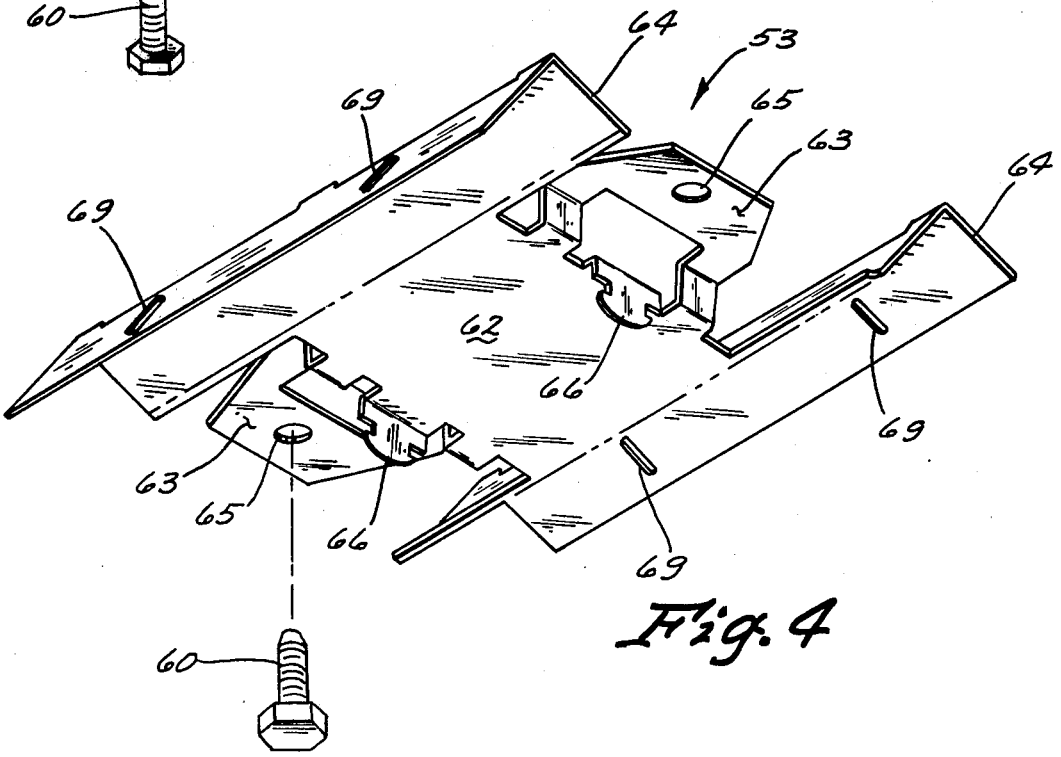
FIG. 4 is a perspective view of another alternate embodiment of the heat shield.

Turning now to FIGS. 3 and 4 there is shown a pair of alternate embodiments of the heat shield identified as numerals 52 and 53. These alternate embodiments are also formed from a light gage stainless steel material and offer similar heat dissipating and reflecting characteristics as compared to the preferred embodiment.

The embodiment shown in FIG. 3 is very similar to the preferred embodiment except for the method of attachment to the wash arm 30. The heat shield 52 as shown in FIG. 3 includes a generally flat elongated body portion 54 having a pair of side segments 55 angularly disposed with respect to the body portion 54. The ends of the heat shield each include a mounting surface 56 in a plane spaced from but generally parallel to that of the body portion 54 with apertures 59 extending therethrough for receiving self-threading fasteners 60. The body portion 54 and the mounting surfaces 56 are joined by a plurality of legs 61 extending therebetween. This alternate heat shield 52 would be attached to the wash arm 30 by driving the fasteners 60 into a pair of bosses which would be molded to the lower half 33 of the wash arm 30.

The heat shield 53 shown in FIG. 4 is also attached to the wash arm 30 by means of a pair of self-threading fasteners 60. In addition to the generally flat elongated body portion 62 and the spaced apart mounting surfaces 63 similar to those shown in FIG. 3 with apertures 65 for receiving fasteners 60, this heat shield 53 includes side segments 64 which are longitudinally extended beyond the body portion 62 and are formed to provide a secondary heat dissipating air space between the wash arm 30 and the heater 40. As FIG. 4 indicates, the elongated body portion 62 further includes a pair of tabs 66 extending at right angles thereto. Each of the side segments 64 include a pair of slots 69 which are engageable with these tabs 66 as the side segments 64 are moved toward the tabs 66 after the heat shield 53 is attached to the wash arm 30. Once attached to the wash arm 30 each of the side segments 64 is folded inwardly so that the slots 69 engage with the tabs 66. This overlapping folding of the side segments 64 provides a pair of metal surfaces adjacent the heater 40 and also provides a second air gap between the overlapping side segments 64 and the body portion 65 of the heat shield 53.

There is thus provided in the instant invention a heat shield 43 operable for protecting a thermoplastic lower wash arm 30 from excessive heat radiated by a sheathed heater 40 mounted on the bottom wall 15 of a dishwasher washing chamber 12 by effectively dissipating this heat. By utilizing this heat shield 43 in conjunction with a thermoplastic lower wash arm 30 it is possible to utilize a relatively high wattage heater 40 without encountering softening or significant heat aging of the wash arm 30. This invention thus allows the significant material savings of substituting a thermoplastic material for stainless steel material and also negates any requirement for limiting the watt density of the heater 40 and for a thermostat to limit temperatures in the vicinity of the wash arm 30.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. An article washing apparatus having a washing chamber and a liquid pumping system associated with the bottom wall thereof, the combination comprising: a rotatable horizontally elongated thermoplastic wash arm associated with said liquid pumping system and operable for effecting the washing of said articles by spraying liquid thereon; means for heating spaced upwardly from said bottom wall generally subjacent said elongated thermoplastic wash arm and energizable for heating said washing chamber; and means rotatable with said thermoplastic wash arm disposed between said means for heating and said thermoplastic wash arm and including heat shield means mounted on said thermoplastic wash arm to effectively shield said thermoplastic wash arm from heat radiated by said heating element.

2. An article washing apparatus as defined in claim 1 wherein said heat shield means includes a pair of generally U-shaped heat shields including a reflective surface and further including side walls generally parallel to the sides of said thermoplastic wash arm.

3. An article washing apparatus as defined in claim 2 and further including a slot associated with one of said thermoplastic wash arm or heat shield and a mating tab associated with the other of said thermoplastic wash arm or heat shield, said slot and mating tab being cooperable for attaching said heat shield to said thermoplastic wash arm.

4. An article washing apparatus as defined in claim 2 wherein said reflective surface is generally arcuately formed for providing substantially equal spacing between said reflective surface and the bottom of said thermoplastic wash arm.

5. An article washing apparatus having a washing chamber and a heating element spaced upwardly from the bottom wall thereof, the combination comprising: means for distributing washing liquid within said washing chamber including pump means associated with the bottom wall of said washing chamber and a rotatable horizontally elongated thermoplastic wash arm in communication with said pump means to effect washing of said articles by spraying liquid thereon; and means for shielding said thermoplastic wash arm from heat radiated by said heating element including at least one generally U-shaped heat reflecting member supported on said rotatable thermoplastic wash arm and positioned between said thermoplastic wash arm and said heating element with a wall portion of said heat reflecting member spaced from said thermoplastic wash arm and providing an air gap therebetween, said wall portion of said heat reflecting member effectively dissipating and reflecting radiant heat from said heating element.

6. An article washing apparatus as defined in claim 5 wherein said thermoplastic wash arm further includes at least one liquid spraying hole directed toward said bottom surface of said heat conductive member for removing debris therefrom.

7. An article washing apparatus as defined in claim 5 and further including a slot associated with one of said thermoplastic wash arm or means for shielding and a mating tab associated with the other of said thermoplastic wash arm or means for shielding, said slot and mating tab being cooperable for attaching said means for shielding to said thermoplastic wash arm.

8. In a dishwashing apparatus having a washing chamber and a pump system for recirculating washing liquid therein to wash dishes, the combination comprising: heating means spaced above and supported on the bottom wall of said washing chamber and energizable during a cycle of operations for alternately heating the washing liquid or air within said washing chamber for drying said dishes; a horizontally elongated thermoplastic wash arm rotatable about the vertical center line of said pump system, said wash arm spaced upwardly from said heating means and including a plurality of spray holes for directing washing liquid onto said dishes; and a generally U-shaped heat shield attached to each end of said rotatable thermoplastic wash arm and including a heat shielding reflective surface disposed between said thermoplastic wash arm and said heating means, said reflective surface extending generally parallel to said thermoplastic wash arm for shielding said thermoplastic wash arm by dissipating and reflecting heat radiated by said heating means.

9. A dishwashing apparatus as defined in claim 8 and further including a plurality of tabs associated with said thermoplastic wash arm and a plurality of mating slots associated with said heat shield means and cooperable one with the other for attaching said heat shield means to said thermoplastic wash arm.

10. A dishwashing apparatus as defined in claim 8 wherein said heating means is generally circular in configuration and substantially concentric with said pump system with said heat shields attached to the ends of said thermoplastic wash arm at the radius of said heating means.

* * * * *